US006718814B2

(12) United States Patent
Bartrom et al.

(10) Patent No.: US 6,718,814 B2
(45) Date of Patent: Apr. 13, 2004

(54) SWAGING DIE ASSEMBLY HAVING COMPRESSIBLE SPACING ELEMENT

(75) Inventors: Michael A. Bartrom, Marion, IN (US); Carl D. Waters, Walton, IN (US)

(73) Assignee: Computer Age Engineering, Marion, IN (US)

( * ) Notice: Subject to any disclaimer, the term of this patent is extended or adjusted under 35 U.S.C. 154(b) by 0 days.

(21) Appl. No.: 10/117,305

(22) Filed: Apr. 5, 2002

(65) Prior Publication Data

US 2002/0144531 A1 Oct. 10, 2002

Related U.S. Application Data

(60) Provisional application No. 60/282,268, filed on Apr. 6, 2001.

(51) Int. Cl.[7] ..... B21D 41/04

(52) U.S. Cl. ..... 72/402; 72/416; 72/466.8

(58) Field of Search ..... 72/402, 399, 466.8, 72/466.9, 465.1, 416; 29/237, 282

(56) References Cited

U.S. PATENT DOCUMENTS

| | | | | | |
|---|---|---|---|---|---|
| 2,921,618 | A | * | 1/1960 | Fuller | 72/308 |
| 3,234,776 | A | * | 2/1966 | Stolz | 72/402 |
| 3,568,495 | A | * | 3/1971 | Duffield | 72/402 |
| 3,750,452 | A | * | 8/1973 | Frank | 72/402 |
| 3,768,298 | A | * | 10/1973 | Olive-Jones et al. | 72/402 |
| 4,464,917 | A | | 8/1984 | Kienhöfer | 72/402 |
| 5,036,691 | A | | 8/1991 | Binhack et al. | 72/76 |
| 5,040,277 | A | | 8/1991 | Dessouky | 29/243.58 |
| 5,353,623 | A | * | 10/1994 | Bobenhausen | 72/402 |
| 5,720,197 | A | * | 2/1998 | Grau et al. | 72/402 |
| 5,983,698 | A | | 11/1999 | Tseng | 72/398 |
| 6,014,801 | A | | 1/2000 | Wilcox | 29/243.525 |

* cited by examiner

*Primary Examiner*—Daniel C. Crane
(74) *Attorney, Agent, or Firm*—Maginot, Moore & Beck

(57) ABSTRACT

A swaging die assembly includes a plurality of die segments and a plurality of compressible spacing elements. Each die segment has a work surface for contacting a workpiece and is movable in a first direction. Each compressible spacing element is interposed between an adjacent pair of compressible spacing elements. Each compressible spacing element is configured to exert a separation force between the adjacent pair of compressible spacing elements. At least one of the compressible spacing elements constructed of polymeric material.

23 Claims, 9 Drawing Sheets

SWAGING DIE ASSEMBLY HAVING COMPRESSIBLE SPACING ELEMENT

This application claims the benefit of U.S. Provisional Patent Application Ser. No. 60/282,268, filed Apr. 6, 2001, which is incorporated herein by reference.

FIELD OF THE INVENTION

The present invention relates generally to the field of machine tools, and more particularly, to the field of tools that operate to reduce the size or diameter of a work piece, or swaging tools.

BACKGROUND OF THE INVENTION

Swaging is a method that is employed to reduce the diameter or thickness of a rod-like or tube-like structure. Swaging may be carried out by forging, squeezing or hammering the work piece. In one type of swaging tool, the work piece is fed into an opening formed by a plurality of die segments arranged generally in a circle. The die segments are forced radially inward to a predetermined point. As the die segments travel radially inward, they converge on the work piece and strike the outer diameter of the work piece, thereby tending to reduce the diameter of the work piece. To force the die segments inward, a moveable tool assembly often engages the outside of the die segments to push them radially inward.

After the swaging operation, the die segments are in a compressed state, substantially surrounding the work piece. To remove the work piece, the die segments must be moved radially backward to an non-compressed or expanded state. Once the die segments are in their normal expanded state, the work piece may be removed and another work piece may be inserted. The process may then be repeated.

In some cases, the swaging mechanism is used on portions of a continuous work piece such as a long continuous tube or pipe. In such cases, the swaging mechanism may operate in a substantially similar manner as described above, except that when the swaging die segments move to the expanded state after swaging one portion of the continuous work piece, the work piece is simply advanced to place an adjacent portion of the work piece in position to be swaged.

In any event, an important part of the swaging operation is the decompression or expansion of the swaging die segments after the swaging step to allow replacement or advancement of the work piece. If the die segments are secured to the moveable tool, then the movement of the moveable tool in the reverse direction would also cause the expansion of the dies segments after completion of the swaging operation. However, it is typically easier to build swaging tools where the moveable tool is not secured to the die segments, but merely engages and pushes the die segments into the compressed state. In such devices, reverse movement of the moveable tool does not move the die segments.

Accordingly, it is desirable to design swaging die segments that are capable of self-separation once the compression force is removed. To this end, the prior art swaging die segments sometimes included springs disposed between adjacent die segments. In particular, when the swaging force is removed from the die segments, the springs tended to push the adjacent die segments apart. As the die segments separated, they moved radially backward away from the work piece.

While the use of springs that are placed between adjacent die segments assists in moving die segments away from the work piece, the springs can be difficult to handle. For example, when the die segments are placed within the swager, each die segment must be individually placed and a spring lodged between the die segment and its adjacent die segment. Thus, replacement of die segments can be difficult.

What is needed, therefore, is a die segment assembly that is both self-separating but does lacks the handling difficulties associated with the use of springs that are trapped between adjacent dies.

SUMMARY OF THE INVENTION

The present invention addresses the above needs, as well as others, by providing a tool die assembly that incorporates a compressible spacing element that may be coupled to at least one of two adjacent die segments. When the compressible spacing element is positively coupled to one or both die segments, handling of the assembly is much easier. Moreover, use of a compressible spacing element that is made of polymer, and/or that has a non-helical, more axially continuous construction, provides compressibility without the inconvenience of springs, and may be more readily coupled to the die segments.

A first embodiment of the present invention is a swaging die assembly that includes a plurality of die segments and a plurality of compressible spacing elements. Each die segment has a work surface for contacting a workpiece and is movable in a first direction. Each compressible spacing element is interposed between an adjacent pair of compressible spacing elements. Each compressible spacing element is configured to exert a separation force between the adjacent pair of compressible spacing elements. At least one of the compressible spacing elements constructed of polymeric material.

A second embodiment of the present invention is also a swaging die assembly that includes a plurality of die segments and a plurality of compressible spacing elements. Again, each die segment has a work surface for contacting a workpiece and is movable in a first direction. Each compressible spacing element is interposed between an adjacent pair of compressible spacing elements and is configured to exert a separation force between the adjacent pair of compressible spacing elements. In the second embodiment, at one least compressible spacing element has an axial dimension extending between the adjacent pair of compressible spacing elements, the at least one compressible spacing element having a continuous axial structure (i.e. non-helical) in an uncompressed state.

A third embodiment of the present invention is similarly a swaging die assembly that includes a plurality of die segments and a plurality of compressible spacing elements. Again, each die segment has a work surface for contacting a workpiece and is movable in a first direction. Each compressible spacing element is interposed between an adjacent pair of compressible spacing elements and is configured to exert a separation force between the adjacent pair of compressible spacing elements. In accordance with a third embodiment, at least one compressible spacing element secured to each of the adjacent pair of die segments, preferably using a coupling member.

The above-described features and advantages, as well as others, will become more readily apparent to those of ordinary skill in the art by reference to the following detailed description and the accompanying drawings.

DETAILED DESCRIPTION

Figure 1:
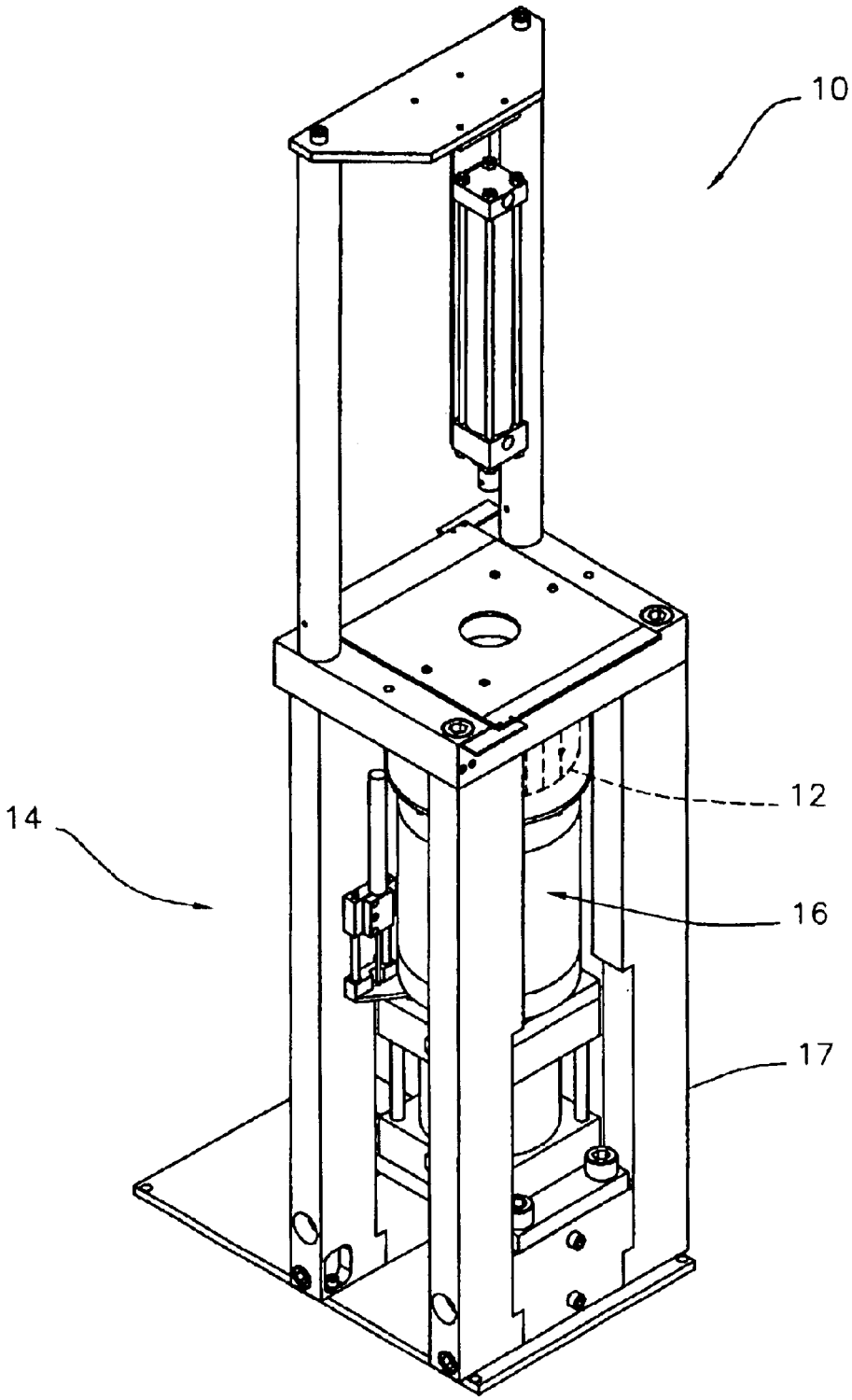
FIG. 1 shows a perspective view of an exemplary swaging assembly 10 that includes an exemplary embodiment of a die assembly 12 according to the present invention.

FIG. 1 shows an overall perspective view of a swaging assembly 10 according to the present invention. In general, the swaging assembly includes a die assembly 12 and a swaging tool 14. The die assembly 12 is hidden from view in FIG. 1 but is shown in perspective to portions of the swaging tool 14 in FIG. 6. Referring again to FIG. 1, the swaging tool 14 includes a movable tool 16 and a frame 17.

The swaging assembly 10 operates generally to reduce the diameter of a work piece in the form of a metal tube or rod, not shown. In the exemplary embodiment described herein, the swaging assembly 10 is configured to swage bushings of various diameters. However, it will be noted that the die assembly 12 according to the present invention may be readily modified by those of ordinary skill in the art for virtually any swaging or other operation that reduces the outer diameter of a tube or rod via force.

As will be described further in detail below in connection with FIGS. 2–8, the movable tool 16 moves with respect to the frame 17 between a rest position and a swaging position. When the movable tool 16 is in the rest position, a work piece to be swaged is placed within the die assembly 12. An illustration of an exemplary embodiment of the die assembly 12 is provided in FIG. 5. The work piece is placed in the center opening 37. The work piece may suitably be placed into position by hand, robotic arm, or by a pick and place mechanism.

Once the work piece is placed within the die assembly 12, the movable tool 16 moves from the rest position to the swaging position. In doing so, the movable tool 16 engages the die assembly 12, thereby forcing the die assembly 12 radially inward toward the work piece. The die assembly 12 converges radially upon the work piece and engages the work piece with sufficient force from multiple directions to reduce its diameter.

After the movable tool 16 is in the swaging position and the die assembly 12 has converged upon the work piece, the movable tool 16 returns to the rest position. The die assembly 12 also expands to allow for ejection of the swaged work piece and to allow insertion of a new work piece to be swaged. To allow such expansion and compression, the die assembly 12 of the present invention includes a plurality of die segments and a plurality of compressible spacing elements. As discussed in further detail below in connection with an exemplary embodiment of the die assembly 12 shown in FIGS. 5 and 5*a*, the compressible spacing elements tend to push the die segments away from each other, which in turn causes the die segments to move radially away from the work piece.

In accordance with the present invention, the compressible spacing elements are constructed of a polymeric material as opposed to metallic springs. The use of polymeric material reduces costs and adds convenience because polymeric material is naturally elastic and need not be formed into a specific complex geometry (i.e. a helical spring) to achieve elasticity. Further detail regarding the structure and geometry of the compressible spacing elements is given further below in connection with FIGS. 5 and 5*a*.

In accordance with a different aspect of the present invention, the compressible spacing elements are secured to the die segments, preferably using fasteners. Securing the compressible spacing elements to the die segments allows for easy removal and replacement of the entire die assembly 12 as a unit. In practice, the swaging tool 14 may be used in conjunction with a plurality of die assemblies to accommodate different sizes of work pieces. Accordingly, it is desirable to facilitate removal and replacement of the die assembly 12 to reduce down time of the swaging assembly 10. In prior art designs, the springs that were used to exert separation force on the die elements of the die assembly were merely trapped between adjacent die elements. As a result, removal of the die assembly typically involved the individual removal of the die elements and springs, which was time consuming. Moreover, the springs could fall out of the die elements and would thus require retrieval. The present invention, by securing the compressible spacing elements to the die elements, eliminates the possibility of falling springs and as well as removal of individual springs.

Figure 5:
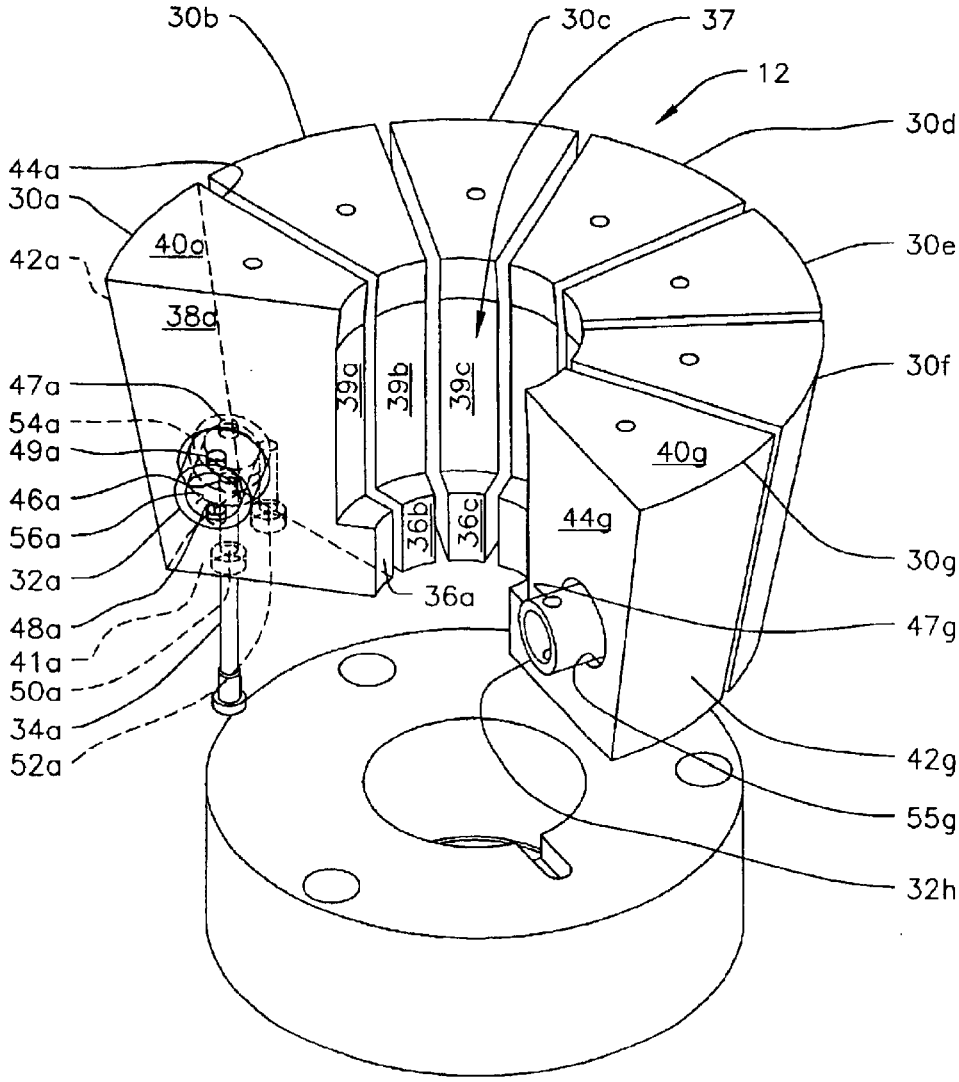
FIG. 5 shows a fragmentary perspective view of an exemplary embodiment of a swaging die assembly according to the present invention.
Figure 5A:
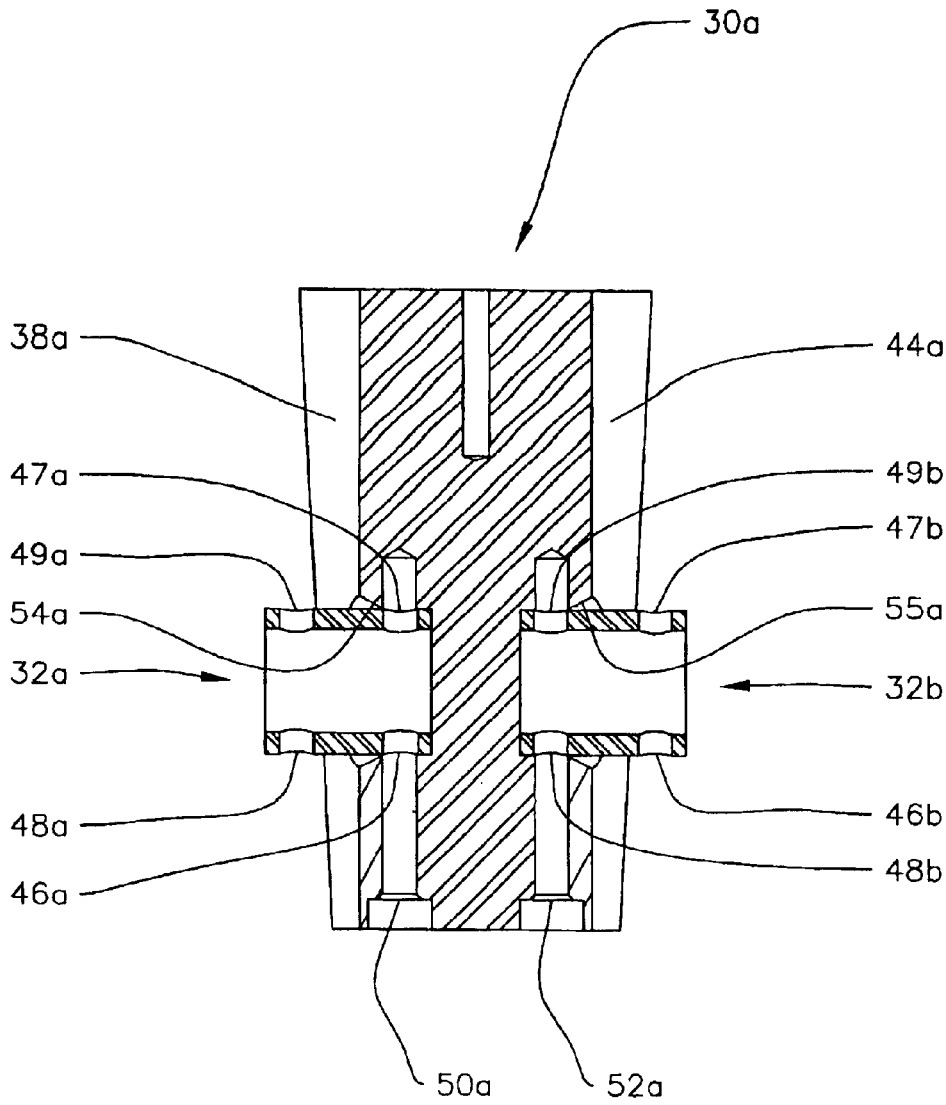
FIG. 5*a* shows a cross sectional view of the swaging die assembly of FIG. 5.

FIG. 5 shows an exemplary embodiment of the die assembly 12 that includes hollow cylindrical compressible spacing elements, for example, the compressible spacing elements 32*a* and 32*g*. The die assembly 12 includes a plurality of die segments 30*x*. In FIG. 5, only seven of the twelve die segments, namely the die segments 30*a*, 30*b*, 30*c*, 30*d*, 30*e*, 30*f* and 30*g*, are shown for purposes of clarity. FIG. 5*a* shows a cross sectional view of the die segment 30*a* with corresponding compressible spacing elements 32*a* and 32*b*.

Each die segment 30*x* is substantially the same. Accordingly, description is provided for an exemplary die segment 30*a* which may be applied to the other die segments. The description of the die segment 30*a* and the die assembly 12 in general will be made with reference to FIGS. 5 and 5*a*.

The die segment 30*a* includes a concave work piece engaging surface 36*a*, a side surface 38*a*, a top surface 40*a*, a bottom surface 41*a*, a tool engaging surface 42*a*, and a second side surface 44*a*. Because of the perspective view, the bottom surface 41*a* and the tool engaging surface 42*a* are not visible in FIGS. 5 and 5*a*. However, the tool engaging surface 42*a* is substantially identical to the tool engaging surface 42*g* of the die segment 30*g*, which is visible in FIG. 5. Moreover, further detail regarding the profile of the tool engaging surface is provided in FIGS. 7 and 8. The detail of the bottom surface 41*a* is readily apparent from its context, as well as from features thereof drawn in phantom in FIG. 5.

The die segment 30*a* is arranged with the other die segments 30*b*, 30*c*, and so forth such that the work piece engaging surfaces 36*a*, 36*b*, 36*c* and so forth define a generally cylindrical opening 37. Because the exemplary die assembly 12 shown herein includes twelve die segments 30*x*, the work piece engaging surface 36*a* extends has a concave shape that defines approximately one-twelfth of the wall that substantially surrounds the opening 37. The shape of the work piece engaging surface 36*a* along the axial direction is largely defined by the shape of the work piece to be swaged, but for tubular or rod-like parts will include a section that is substantially uniform in the axial direction. The die segment 30*a* further includes a recessed extension 39*a* that extends from the top of the work piece engaging surface 36*a* to the top surface 40*a*.

It will be appreciated that a work piece with multiple diameters may require die segments 30*x* having engaging surfaces 36*x* that are not axially uniform.

The side surfaces 38*a* and 44*a* extend radially outward from the work piece engaging surface 36*a* to the tool engaging surface 42*a*, thereby defining the shape of the die segment 30*a* as a portion of a wedge. The side surface 38*a* includes a first cavity 54*a* for receiving a part of a compressible spacing element 32*a*. Similarly, the second side surface 44*a* includes a second cavity 55*a* for receiving a part of another compressible spacing element 32*b* (not shown in FIG. 5).

The bottom surface 41*a* includes two bores 50*a* and 52*a*. The first bore 50*a* extends to and is in communication with the first cavity 54*a*. The second bore 52*a* extends to and is in communication with the second cavity 55*a*.

In the exemplary embodiment described herein, all of the compressible spacing elements 32*a*, 32*b*, 32*c* and so forth have substantially identical structures. Accordingly, description is only provided for the compressible spacing element 32*a*. The compressible spacing element 32*a* preferably comprises a cylindrical tube of polymeric material. However, the compressible spacing element 32*a* may be another shape, preferably hollow, and still retain many of the advantages of the present invention. The compressible spacing element 32*a* includes a first fastener aperture 46*a*, a first opposite fastener aperture 47*a*, a second fastener aperture 48*a*, and a second opposite fastener aperture 49*a*.

In a preferred embodiment, the compressible spacing element 32*a* is constructed of polyurethane having a durometer reading of approximately 95*a*. The thickness of the walls of the hollow cylindrical element is between one-eighth inch and one-quarter inch. This combination has been found to provide adequate strength, resiliency, and compressibility for die segments that are between four to six inches in height and three to five inches in radial width.

The first fastener 34*a* extends upward through the first bore 50*a*, the first fastener aperture 46*a*, and the first opposite fastener aperture 47*a*. In this manner, the first fastener 34*a* serves to fasten the compressible spacing element 32*a* to the die segment 30*a*. In a similar manner, another fastener, not shown, secures the other compressible spacing element 32*b* to the die segment 30*a*. Likewise, yet another fastener, not shown, passes through a bore in an adjacent die segment, not shown, and through the second fastener aperture 48*a* and second opposite fastener aperture 49*a* to secure the compressible spacing element 32*a* to that adjacent die segment. In this manner, the various segments 30*a*, 30*b* and so forth are linked to each other via the compressible spacing elements 32*a*, 32*b* and so forth.

It will be appreciated that the die assembly 12 may alternatively include a different number of elements as appropriate for the implementation. Swaging die assemblies having as little as four or even two die elements can perform swaging operations sufficient in some industries. Such alternative arrangements may nevertheless benefit from many advantages provided by the present invention.

Moreover, it will be appreciated that even if helical springs are used as the compressible spacing elements, at least some of the advantages of the present invention that arise from securing the compressible spacing elements to the die segments may be obtained. In addition, the compressible spacing elements may be secured to the die elements using something other than mechanical fasteners, such as a mechanical snap fit interlock or adhesive bonding or welding. Finally, even if the compressible spacing elements are not secured to the die segment, the use of a flexible polymer as the compressible spacing elements provides many of the advantages of the present invention, including cost advantages over the use of metallic springs.

As discussed above in connection with FIG. 1, the swaging tool 14 includes a frame 17 and a moveable tool 16. In general, the moveable tool 16 is configured to engage the tool engaging surfaces 42*a*, 42*b*, and so forth of the die assembly 12 to place the die assembly 12 in the swaging position. The frame 17, in general, provides a housing in which the moveable tool 16 and the die assembly 12 may be fixtured. While various configurations of the moveable tool 16 and frame 17 may be envisioned for use in connection with the die assembly of the present invention, and indeed even for the exemplary embodiment of the die assembly 12 of the present invention shown in FIGS. 5 and 5*a*, FIGS. 1–4 and 6–8 show a preferred embodiment of the swaging tool 14 for use in connection with the die assembly 12 of FIGS. 5 and 5*a*.

With reference to FIGS. 2–4 and 6–8 in particular, the moveable tool 16 comprises a spacer tube 18, a drive disk 20, a cylinder 22 and a drive ring 26. The frame 17 comprises a base 58, upright supports 60, 62, 64 and 66, a center base support 68, a cross member 70, a cylinder frame 72, a top plate 100, an access plate 108, a wear plate 106, upper supports 116 and 118, and an upper plate 120.

Figure 2:
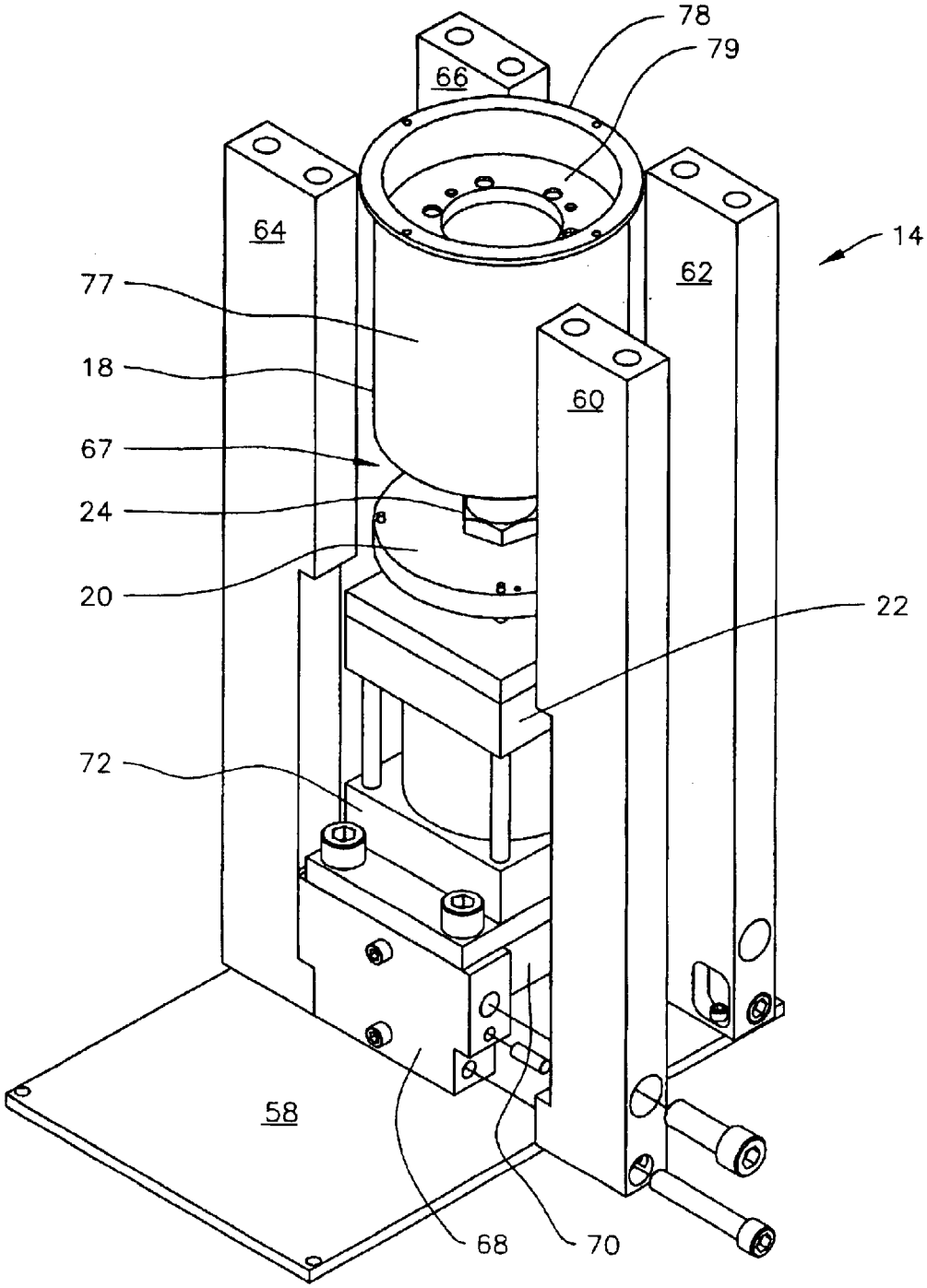
FIG. 2 shows a partially exploded perspective view of a lower portion of the swaging tool of the swaging assembly of FIG. 1.
Figure 4:
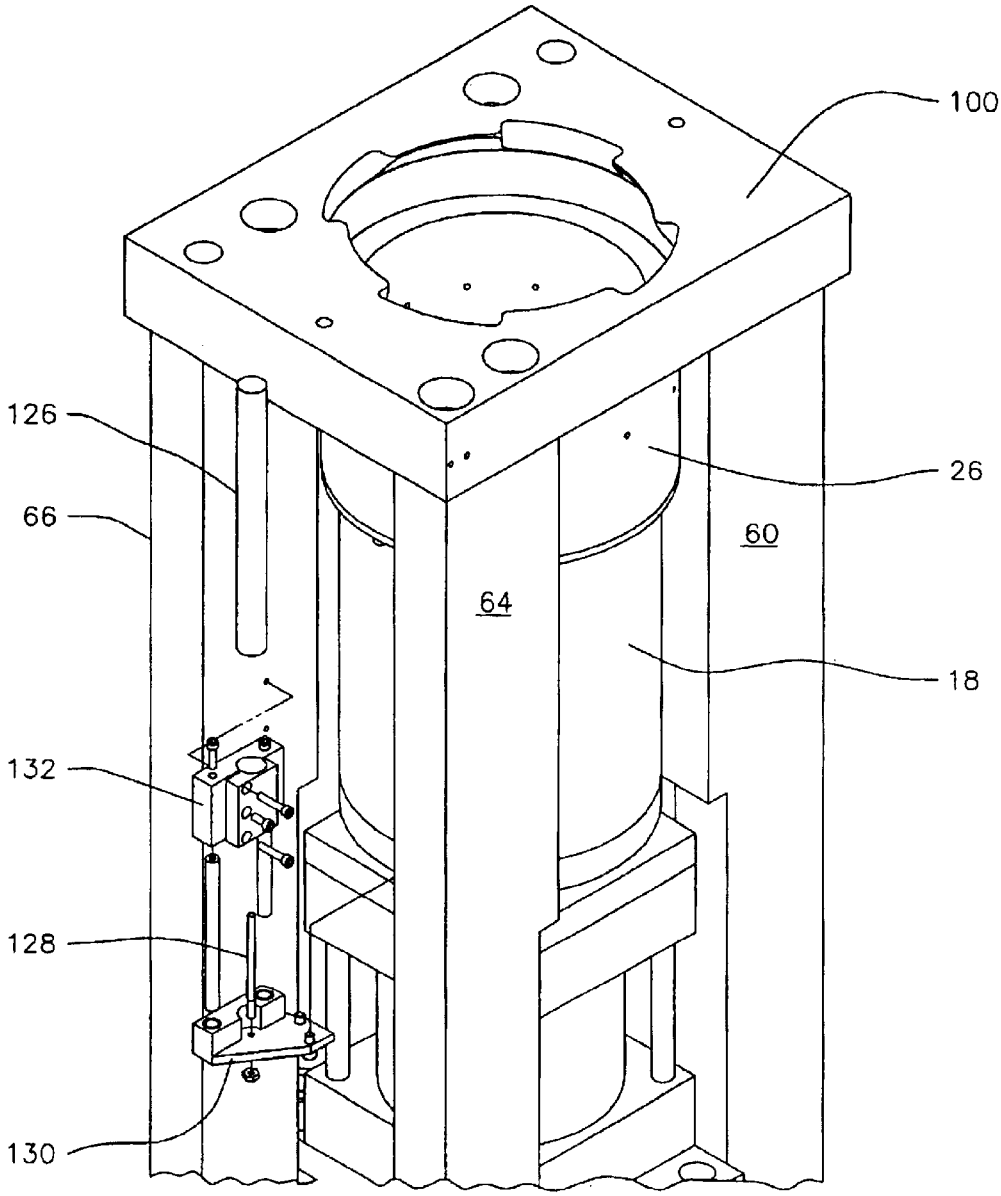
FIG. 4 shows a different partially exploded perspective view of a lower portion the swaging tool of the swaging assembly of FIG. 1.

With reference to FIGS. 2 and 4 specifically, the base plate 58 is preferably rectangular and sits on a flat surface. The upright supports 60, 62, 64 and 66 are secured to the base plate 58 and extend upward therefrom to the top plate 100. The upright supports 60, 62, 64 and 66 are elongated support members that are disposed in a rectangular pattern on the base plate 58. As a result of the rectangular pattern, the upright supports 60, 62, 64 and 66 form a substantially rectangular frame interior 67 in which the moveable tool 16 and die assembly 12 are disposed. To this end, the upright supports 60, 62 64 and 66 are also long enough to allow the moveable tool 16 and die assembly 12 to fit between the base plate 58 and the top plate 100.

The center base support 68 sits upon the base plate 58 and extends between the upright supports 60 and 64. A similar base support, not shown, sits upon the base plate 58 and extends between the upright supports 62 and 66. The cross member 70 extends between the center base support 68 and the opposing center base support referenced above.

The cylinder frame 72 houses the hydraulic cylinder 22. The cylinder frame 72 is disposed on and is secured to the top of the center base support 68, opposing center base support, and the cross member 70. The cylinder 22 includes a rod, not shown, but which is fixedly secured to the drive disk 20 by a rod nut 24. The drive disk 20 is a round disk of significant thickness. The cylinder 22 is arranged such that actuation of the cylinder 22 causes the rod, the drive disk 20 and the rod nut 24 to move vertically within the frame interior 67.

The drive disk 20 is in a driving relationship with the spacer tube 18. The spacer tube 18 has a generally cylindrical body 77, an annular flange 78, and an inner annular shelf 79. The annular flange 78 is disposed at the upper axial edge of the cylindrical body 77 and the inner annular shelf 79 is disposed within the cylindrical body offset from the upper axial edge.

The generally cylindrical body 77 has a diameter that is largely coextensive with the diameter of the drive disk 20 and the diameter of drive ring 26. Because the drive disk 20, the cylindrical body 77, and the drive ring 26 all have substantially the same radius, a balanced force may be applied throughout the circumference of the drive ring 26 during the swaging process. As will be discussed further below, it is the drive ring 26 imparts the swaging force to the die assembly 12. Accordingly, a balanced swaging force throughout the circumference of the drive ring 26 is desirable to achieve favorable swaging results and to prolong the life of the swaging tool 14.

The drive ring 26 is also a generally cylindrical body, having a largely cylindrical outer surface 74 and a chamfered or frustoconical inner surface 76. As will be discussed in further detail below, the chamfered inner surface 76 provides the translation of force between the vertical movement of the cylinder 22 and the radially inward movement of the die segments 30*a*, 30*b*, and so forth.

Figure 6:
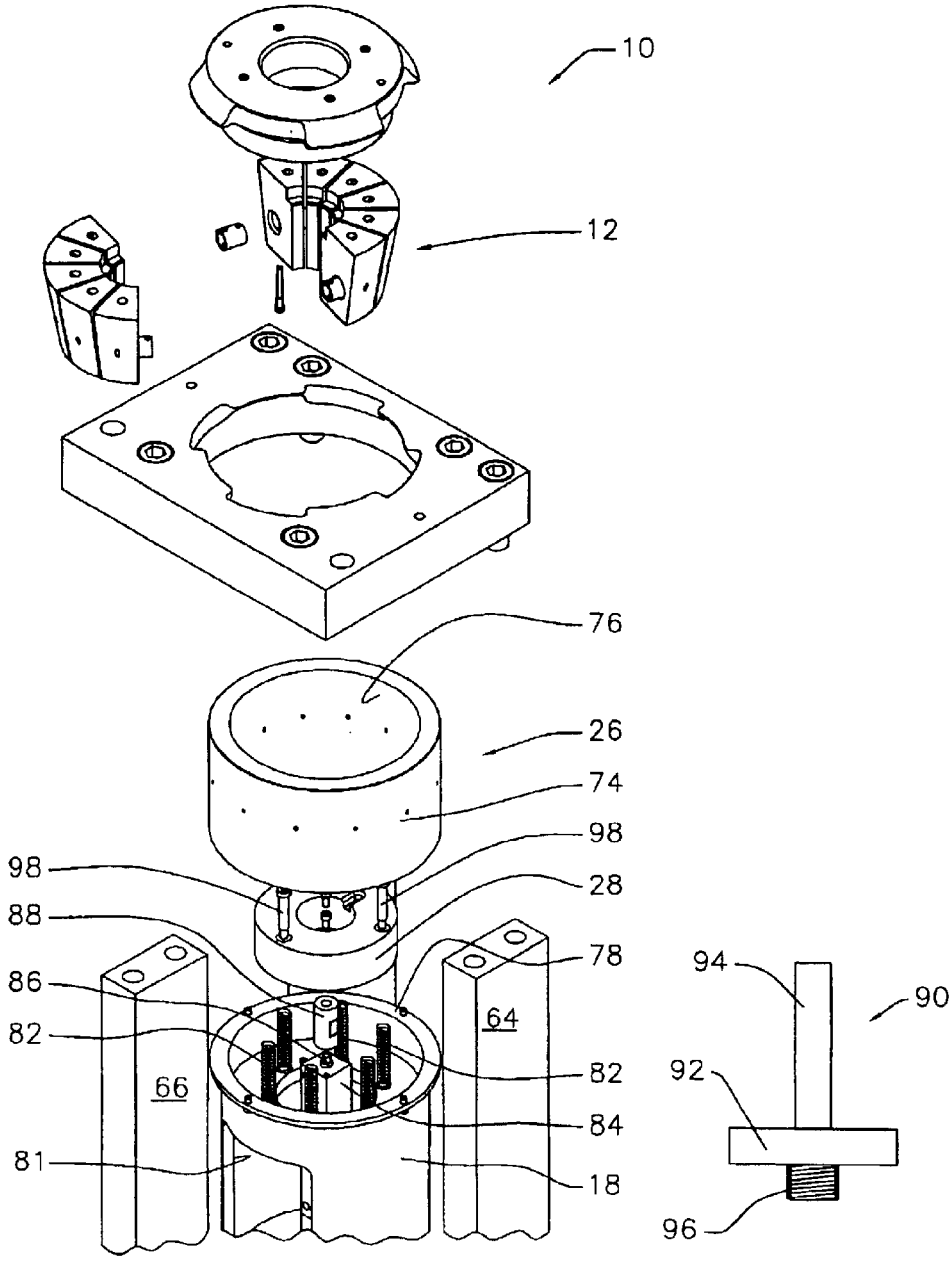
FIG. 6 shows an exploded perspective view of several elements of the swaging tool and the die assembly of FIGS. 1 and 5.

Referring particularly to FIG. 6, the bottom edge of the drive ring 26 is fixedly secured to the annular flange 78 of the spacer tube 18. The pressure disk 28 is secured to the inner annular shelf 79 using an arrangement that includes a plurality of fasteners 98 and a plurality of springs 82. In general, the pressure disk 28 is a substantially circular disk with a center aperture. The pressure disk 28 withstands some of the force of the swaging operation, and thus has appropriate thickness, greater than one inch, in both the axial and radial directions. The radial thickness of the pressure disk 28 is also sufficient to provide sufficient area contact between the pressure disk 28 and the bottom of the die segments 30*a*, 30*b*, and so forth.

Figure 7:
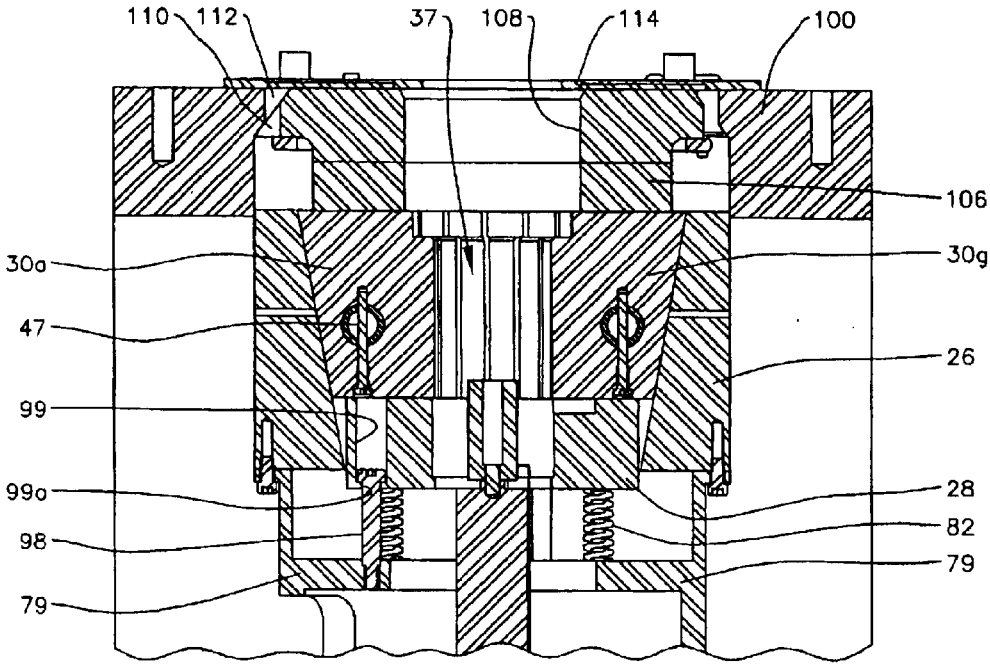
FIG. 7 shows a fragmentary cutaway portion of the swaging assembly of FIG. 1 wherein the movable tool is in the rest position.
Figure 8:
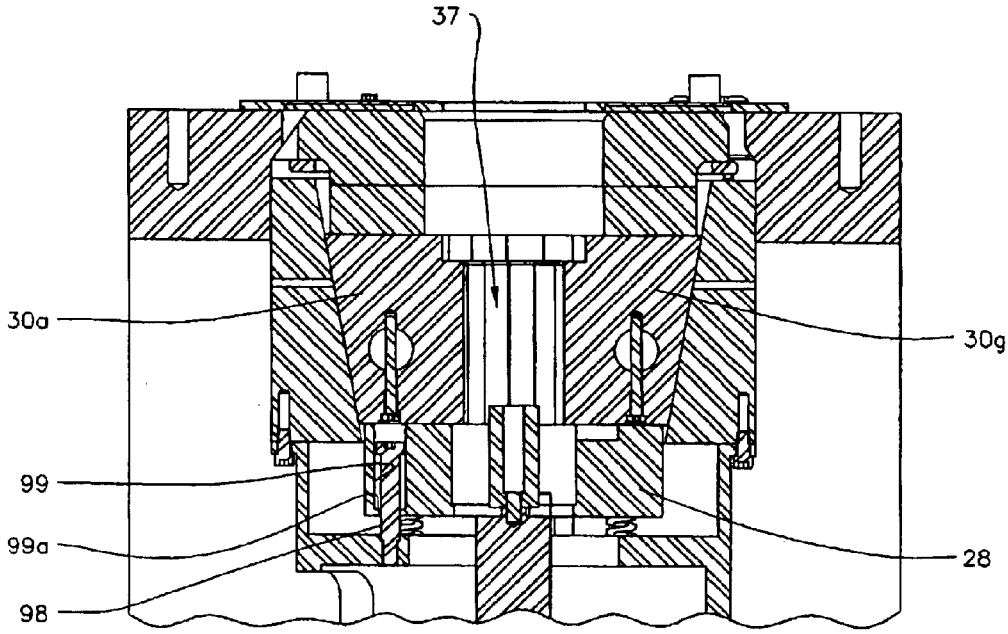
FIG. 8 shows a fragmentary cutaway portion of the swaging assembly of FIG. 1 wherein the movable tool is in the swaging position.

As discussed above, the fasteners 98 and the springs 82 cooperate to define the coupling relationship between the pressure disk 28 and the spacer tube 18. With reference to FIGS. 6, 7 and 8, each of the plurality of fasteners 98 extends into a cavity 99 within the pressure disk 28. Each cavity 99 has a width that is sufficient to allow each fastener 98 to move vertically within the cavity. Each fastener 98 extends out of the cavity 99 through an aperture 99*a* and into an aperture in the inner annular shelf 79. Each fastener 98 includes a head portion 98*a* that is of a size that permits it to travel within the cavity 99 but not to pass through the aperture 99*a*.

The springs 82 engage and extend between the inner annular shelf 79 and the pressure disk 28. The springs 82 are biased to provide separation force between the inner annular shelf 79 and the pressure disk 28. Accordingly, when the moveable tool 16 is in the rest position, as shown in FIG. 7, the pressure disk 28 may typically rest at a point in which the springs 82 force the pressure disk 28 away from the spacer tube 18 to the further extent possible, i.e., when the head portion 98*a* of each fastener engages the corresponding aperture 99*a*.

Referring again generally to FIGS. 4, 6, 7 and 8, the die assembly 12 is disposed generally above and preferably on top of the pressure disk 28. The pressure disk 28 and the die assembly 12 are aligned concentrically with the drive ring 26 and the spacer tube 18. The drive ring 26, which is secured to the annular flange 78 of the spacer tube 18, extends up and around the die assembly 12, as well as around much of the pressure disk in the rest position as shown in FIG. 7. It will be appreciated that the outer diameter of the pressure disk 28 is less than the smallest diameter of the inner ring surface 76 to allow the drive ring 26 to move freely about the pressure disk 28.

Several components provide resistive downward force to maintain the vertical position of the die assembly 12 during the swaging process. In accordance with another independent aspect of the present invention, such components facilitate expeditious placement and removal of the die assembly 12. The ability to quickly remove and replace the die assembly 12 has significant advantages. For example, a particular type of part may be swaged in the swaging assembly 10 for as little as a few hours or a day before another type of part is to be swaged. The ability to change out die assemblies quickly makes frequent changes in parts to be swaged more feasible.

Figure 3:
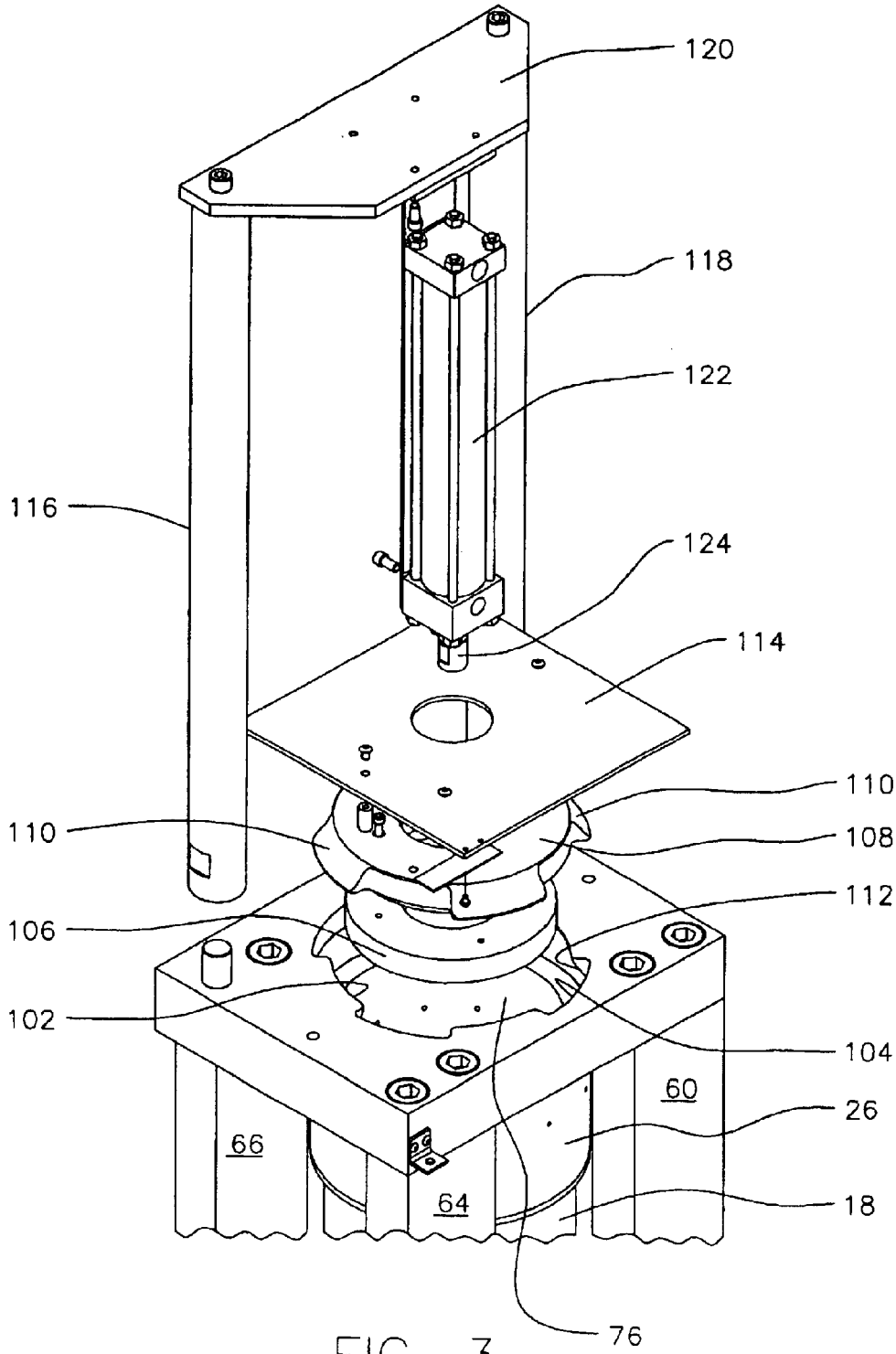
FIG. 3 shows a partially exploded perspective view of an upper portion of the swaging tool of the swaging assembly of FIG. 1.

In any event, the components of the exemplary embodiment described herein that provide the downward resistive force to the die assembly 12 include the top plate 100, a wear plate 106, and an access plate 108. Referring also to FIG. 3, the top plate 100 has a generally rectangular shape that corresponds to the rectangle defined by the position of the upright supports 60, 62, 64 and 66. Indeed, the top plate 100 is fixedly secured to the upright supports 60, 62, 64 and 66 at its comers. In the center of the top plate 100 is a circular center opening 102 that has sufficient size to allow for placement and removal of the die assembly 12 without removing the top plate 100 from the upright supports 60, 62, 64 and 66. The center opening 102 is generally circular, but also includes a number of cut out slots 104 that are spaced apart throughout the outer circumference of center opening 102. Adjacent and between the cutout slots 104 are chamfered edges 112 of the top plate 100.

The wear plate 106 is a generally circular structural disk that is aligned concentrically with and disposed on top of the die assembly 12. The wear plate 106 has a center opening having a size sufficient to allow placement and removal of the work piece therethrough. The wear plate 106 outer diameter is preferably configured such that the wear plate may be removed through the center opening 102 of the top plate 100.

The access plate 108 is a structural element that also generally circular, but includes a number of chamfered locking extensions 110 extending from the generally circular shape. The nominal outer diameter of the access plate 108 is substantially the same as, but slightly smaller than, the dimension between the chamfered edges 112 of the top plate 100. The locking extensions 110 extend from the nominal out diameter and are disposed in a pattern on the access plate 108 that corresponds to the pattern of the cut out slots 104 of the top plate 100.

The locking extensions 110 define an outer diameter that is larger than the dimension between opposing chamfered edges 112 of the top plate 100, but smaller than the dimension between opposing cut out slots 104 of the top plate 100. Accordingly, when the locking extensions 110 are aligned with the cut out slots 104, the access plate 108 may be inserted into or removed from the center opening 102. In addition, the locking extensions 110 are chamfered to allow them to be received under the chamfered edges 112 of the top plate 100. When the locking extensions 110 are disposed under the chamfered edges 112, the access plate 108 is locked in place.

During normal swaging operations, the access plate 108 is locked in place as shown in FIGS. 7 and 8. In that position, the access plate 108 engages the wear plate 106, which in turn, as discussed above, engages the die assembly 12. The combined structure of the top plate 100, the access plate 108 and the wear plate 106 thus serves to secure the die assembly in its vertical or axial position.

It is noted that the wear plate 106 need not be a separate element but instead may constitute an extension of the access plate 108. However, the use of a separate wear plate 106 as shown herein has advantages over a single piece construction. In particular, it has been found that repeated swaging operations cause wear-related damage to the surface of a wear plate such as the wear plate 106. Over time, the accumulated damage to the wear plate 106 can adversely affect the swaging process and the wear plate 106 must be replaced. If the wear plate 106 and the access plate 108 are integrally formed, then the replacement cost is substantially higher. Accordingly, by using a separate wear plate 106, the reconditioning of the swaging assembly 10 to remedy accumulated wear-related damage to the wear plate becomes appreciably less expensive.

In general, the work piece to be swaged is fixtured within the center opening 37 of the die assembly 12. To this end, in reference to FIG. 6, the work piece is supported by a bushing fixture 90, an eject cylinder 84, and preferably an adapter 88. The eject cylinder 84 is disposed within the cylindrical body 77 of the spacer tube 18 and is configured to remain stationary when the drive disk 20, spacer tube 18 and drive ring 26 move vertically. To this end, the eject cylinder 84 is fixtured to the upright support 66 using a fixturing support, not shown, that passes through an opening 81 in the spacer tube 18. The eject cylinder 84, however, is operable to move vertically in order to eject the work piece from the die assembly 12, as discussed further below.

The bushing fixture 90 is coupled to the eject cylinder 84 through the adapter 88. The eject cylinder 84 includes a threaded extension 86 onto which the adapter 88 is disposed. Accordingly, the adapter 88 is internally threaded to receive the threaded extension 86. The adapter 88 is an elongated supporting extension element that is illustratively cylindrical. However, the adapter 88 may be of any cross sectional shape as long as it operates as a spacer between the eject cylinder 84 and the bushing fixture 90.

The bushing fixture 90 comprises a fixture base 92, an elongated spindle 94, and a threaded anchor 96. The bushing fixture 90 is illustrative of a work piece fixture that is particularly suitable for work pieces in the form of bushings. Other fixtures may be developed by the ordinary skilled artisan for other types of work pieces. In the illustrative embodiment, the threaded anchor 96 is rotatably received into the adapter 88 to secure the bushing fixture 90 within the frame interior 67. The spindle 94 and base 92 are configured to receive the bushing and support the bushing within the center opening 37 of the die assembly 12.

The upper portions of the frame 17 shown in FIG. 3 are employed primarily to assist in automating the process of fixturing the work piece within the die assembly 12 in the frame interior 67. The upper portions of the frame 17 include the upper supports 116 and 118, the upper plate 120, the hold down cylinder 122, the hold down button 124. The upper supports are elongated structural members that extend upward from and are secured to the top plate 100 at the comers of the top plate 100 that are secured to the upright supports 62 and 66. The upper plate 120 comprises a relatively flat support plate that is secured to and supported by the upper supports 116 and 118. The upper plate 120 provides an overhead anchor for the hold down cylinder 122.

The hold down cylinder 122 is an ordinary hydraulic cylinder that is secured to and extends downward from the upper plate 120. The hold down button 124 is a cylindrical element that is secured to the piston, not shown, of the hold down cylinder 122 and extends therewith. The hold down cylinder 122 and hold down button 124 engage the work piece when it is fixtured in the die assembly 12. More particularly, the hold down cylinder 122 and hold down button 124 ensure the that the work piece is adequately fixtured in the swaging tool 14 by reference to a predetermined cylinder position value. In other words, the hold down cylinder 122 is configured to provide feedback regarding its position and that position can be compared to the proper position for the hold down cylinder 122 if the bushing/work piece is properly fixtured. If the hold down cylinder 122 is in the proper position, then the work piece is properly fixtured and the swaging operation may commence. If not, however, then the swaging operation should not occur and corrective measures may be required. Such features are particularly useful in automating the fixturing process.

In addition to the above elements, the swaging tool 14 further includes a device that provides position feedback for the cylinder 22 of the moveable tool 16. In the exemplary embodiment described herein, the position feedback device is a linear velocity displacement transducer ("LVDT"). As shown in FIG. 4 in exploded view, the LVDT includes an LVDT encoder 126, an armature 128, an armature mount 130, and a clamp 132. The armature mount 130 and the clamp 132 are fixedly secured to the upright support 66. The LVDT encoder 126, armature, and other elements are arranged as is well known in the art to provide position feedback regarding the travel of the cylinder 22.

The operation of the swaging tool 10 will be described with reference to performing a swaging operation on a work piece in the form of a bushing that is delivered to the vicinity of the center opening 37 of the die assembly 12. To this end, a pick and place device, robotic arm, or other automated device may be used to dispose the work piece through the circular center opening 102 of the top plate 100, through the access plate 108 and the wear plate 106 onto the spindle 94 of the bushing fixture 90 in the center opening 37 of the die assembly 12. (See FIG. 7). During the fixturing process, the moveable tool 16 is in the rest position.

After the workpiece has been placed into position, the hold down cylinder 122 moves the hold down button 124 to engage the work piece. Once engaged, the hold down cylinder 122 the hold down button 124 and the work piece until a predetermined position is reached. This ensures that the work piece is properly fixtured in automated processes. In alternative embodiments, the work piece may be manually fixtured. In such cases, the hold down cylinder 122 and associated components would not be required.

Once properly fixtured, the moveable tool 16 moves from the rest position (FIG. 7) to the swaging position (FIG. 8). To this end, the cylinder 22 forces the drive disk 20 in a vertically upward direction. The drive disk 20 thus drives the spacer tube 18 in the same direction. As the spacer tube 18 moves vertically upward, it imparts and upward force on the drive ring 26.

In addition, as the spacer tube 18 moves upward, it moves toward the pressure disk 28. Although some of the force of the upward movement is translated through the inner annular shelf 79 and the springs 82 to the pressure disk 28, the pressure disk 28 cannot move vertically. In particular, the pressure disk 28 cannot move because it is trapped by the interfering placement of the die assembly 12, the wear plate 106, the access plate 108 and the top plate 100. Accordingly, the die assembly 12 likewise does not move vertically.

Referring specifically to FIGS. 7 and 8, as shown in FIG. 8, as the spacer tube 18 moves upward, the springs 82 compress to allow the relative movement between the annular shelf 79 and the pressure disk 28. Moreover, as the drive ring 26 moves upward, its inner surface 76 engages the tool engaging surface 42 of the each of the die segments 30*a*, 30*b*, and so forth. The corresponding sloped surfaces of the inner surface 76 of the drive ring 26 and the tool engaging surfaces 42 cooperate to translate the vertical or axial movement of the drive ring 26 to radially inward movement of the die segments 30*a*, 30*b* and so forth.

The radially inward movement of the die segments 30*a*, 30*b* and so forth converge upon the work piece within the center opening 37. The work piece engaging surfaces 36*a*, 36*b*, and so forth engage the work piece and forcibly reduce its diameter, thereby performing the swaging operation. The amount of swaging is controlled by the vertical stroke of the cylinder 22. The LVDT encoder 126 is used as closed loop feedback to tightly control the vertical stroke of the cylinder.

During the radially inward movement of the die segments 30*a*, 30*b*, and so forth, the compressible spacing elements 32*a*, 32*b* and so forth become compressed along their axial direction. The axial compression typically causes temporary radial displacement of the compressible spacing element material. For example, a relatively long, thin compressible spacing element 32*a* compresses to a relatively short, fat compressible spacing element 32*a*. To this end, referring to FIGS. 5, 7 and 8, it is noted that the cavities 54*a*, 54*b* and so forth and 55*a*, 55*b* and so forth must be configured to have room for the radial expansion of the compressible spacing elements 32*a*, 32*b* and so forth. In other words, the radial dimension of each cavity 54*x* and 55*x* must exceed the outer radius of the uncompressed compressible spacing element 32*x*.

It is noted that during the movement from the rest position to the swaging position, the disk fasteners 98 move with the annular shelf 79, to which they are secured. The disk fasteners 98 move vertically within the cavity 99 formed in the pressure disk 28.

After the swaging force has been applied, the moveable tool 16 returns to the rest position as shown in FIG. 7. To this end, the cylinder 22 moves the drive disk 20 vertically downward. Gravity and/or the decompression force of the springs 82 cause the spacer tube 18 and the drive ring 26 to move downward. In addition, the compressing spacing elements 32*a*, 32*b*, and so forth impart a separating force between adjacent die segments 30*a*, 30*b*, and so forth. This separation force is translated by the configuration of the die assembly 12 to a radially outward force. The separation force urges the die assembly 12 into its rest or expanded position in which the center opening 37 is expanded. When the center opening 37 is expanded, the work piece may be replaced. Once the work piece is replaced, the above described process may be repeated to swag the new work piece.

Accordingly, the embodiment describe above illustrates one environment in which a die assembly according to the present invention may be used. However, various types of moveable tools and/or frame configurations may be employed that still require a die assembly that includes multiple segments with compressible spacing elements therebetween. Many of the advantages of the present invention translate to any such embodiments.

In addition, the swaging assembly 10 described above includes one or more independent inventions either partially related or entirely unrelated to the inventive die assembly described herein.

In any event, it will be appreciated that the above described embodiments are merely illustrative, and that those of ordinary skill in the art may readily devise their own implementations that incorporate the principles of the present invention and fall within the spirit and scope thereof. For example, as discussed above, the compressible spacing element used in the die assembly of the present invention may take many forms and still provide advantages over the metal spring configuration. In particular, a compressible spacing element constructed of an elastic material such as polymer may be fashioned to provide a spring action that require less manufacturing complexity than a metal spring. Indeed, any shaped device that is axially continuous, i.e, not exclusively helical, provides at least some of the advantages over the use of metal springs. Hollow elements are particularly advantageous because they provide more room for the compressed polymer to expand radially and allow more axial compression. Hollow cylinders are most advantageous.

We claim:

1. A swaging die assembly, comprising:

a plurality of die segments, each die segment having a work surface for contacting a workpiece, each die segment being movable in a first direction, each die segment including at least a first cavity; and a plurality of compressible spacing elements, each compressible spacing element being interposed between an adjacent pair of die segments, a portion of at least one of the compressible spacing elements received in the first cavity of at least one of the pair of die segments, each compressible spacing element comprising a hollow element and configured to exert a separation force between the adjacent pair of die segments, at least one compressible spacing element constructed of polymeric material.

2. The swaging die assembly of claim 1, wherein the at least one compressible spacing element comprises an elastically deformable hollow element.

3. The swaging die assembly of claim 2, wherein the elastically deformable hollow element comprises a hollow cylindrical element.

4. The swaging die assembly of claim 2, wherein the elastically deformable hollow element is coupled to each of the adjacent pair of die segments.

5. The swaging die assembly of claim 4, further comprising a first coupling element, said first coupling element received by at least a first aperture in the elastically deformable hollow element, said first coupling element further received by a first of the adjacent pair of die segments.

6. The swaging die assembly of claim 5, wherein the elastically deformable hollow element further comprises a second aperture, the second aperture receiving the first coupling element.

7. The swaging die assembly of claim 5, further comprising a second coupling element, said second coupling element received by at least a second aperture in the elastically deformable hollow element, said second coupling element further received by a second of the adjacent pair of die segments.

8. The swaging die assembly of claim 1, wherein each of the plurality of die segments includes a second surface for receiving a moving tool element, each of the plurality of die segments operable to move in the first direction responsive to the second surface receiving the moving tool element.

9. The swaging die assembly of claim 8 wherein each of the plurality of die segments extends in the first direction from the second surface to the first surface.

10. The swaging die assembly of claim 1 wherein the plurality of die segments are arranged such that the first surfaces of the plurality of die segments forms a generally circular pattern.

11. A swaging die assembly, comprising:

a plurality of die segments, each die segment having a work surface for contacting a workpiece, each die segment being movable in a first direction, each die segment including a first cavity; and a plurality of compressible spacing elements, each compressible spacing elements being interposed between an adjacent pair of die segments, a first end of at least one compressible spacing element extending into the first cavity of one of the adjacent pair of die segments, each compressible spacing element configured to exert a separation force between the adjacent pair of die segments, at one least compressible spacing element having an axial dimension extending toward each of the adjacent pair of die segments, the at least one compressible spacing element having a continous axial structure in an uncompressed state.

12. The swaging die assembly of claim 11 wherein the at least one compressible spacing element includes a hollow element having external walls, and wherein the continuous axial structure includes at least a portion of at least one of the external walls.

13. The swaging die assembly of claim 12 wherein the hollow element comprises a generally cylindrical element.

14. The swaging die assembly of claim 11, wherein the at least one compressible spacing element is coupled to each of the adjacent pair of die segments.

15. The swaging die assembly of claim 14, further comprising a first coupling element, said first coupling element received by at least a first aperture in the at least one compressible spacing element, said first coupling element further received by a first of the adjacent pair of die segments.

16. The swaging die assembly of claim 15, wherein the at least one compressible spacing element further comprises a second aperture, the second aperture receiving the first coupling element.

17. The swaging die assembly of claim 15, further comprising a second coupling element, said second coupling element received by at least a second aperture in the compressible spacing element, said second coupling element further received by a second of the adjacent pair of die segments.

18. The swaging die assembly, comprising:

a plurality of die segments, each die segment having a work surface for contacting a workpiece, each die segment being movable in a first direction;

a plurality of compressible spacing elements, each compressible spacing element being interposed between an adjacent pair of die segments, each compressible spacing element configured to exert a separation force between the adjacent pair of die segments, at least one compressible spacing element secured to each of the adjacent pair of die segments; and a first coupling element for securing the compressible spacing element to the die segment, said first coupling element being separate from said die segments, said first coupling element received by at least a first aperture in the at least one compressible spacing element, said first coupling element further received by a first of the adjacent pair of die segments.

19. The swaging die assembly of claim 18, wherein the at least one compressible spacing element further comprises a second aperture, the second aperture receiving the first coupling element.

20. The swaging die assembly of claim 18, further comprising a second coupling element, said second coupling element received by at least a second aperture in the compressible spacing element, said second coupling element further received by a second of the adjacent pair of die segments.

21. The swaging die assembly of claim 18, wherein each of the plurality of die segments includes a second surface for receiving a moving tool element, each of the plurality of die segments operable to move in the first direction responsive to the second surface receiving the moving tool element.

22. The swaging die assembly of claim 21 wherein each of the plurality of die segments extends in the first direction from the second surface to the first surface.

23. The swaging die assembly of claim 18 wherein the plurality of die segments are arranged such that the first surfaces of the plurality of die segments forms a generally circular pattern.

* * * * *